US008827003B2

(12) United States Patent
Nagasaka et al.

(10) Patent No.: US 8,827,003 B2
(45) Date of Patent: Sep. 9, 2014

(54) IMPACT TOOL

(75) Inventors: Hidenori Nagasaka, Anjo (JP); Ryunosuke Kumagai, Anjo (JP)

(73) Assignee: Makita Corporation, Anjo-shi (JP)

( * ) Notice: Subject to any disclaimer, the term of this patent is extended or adjusted under 35 U.S.C. 154(b) by 686 days.

(21) Appl. No.: 13/115,364

(22) Filed: May 25, 2011

(65) Prior Publication Data

US 2012/0000683 A1 Jan. 5, 2012

(30) Foreign Application Priority Data

Jul. 5, 2010 (JP) ..... 2010-153271

(51) Int. Cl.
*B25B 21/02* (2006.01)

(52) U.S. Cl.
CPC ..... *B25B 21/026* (2013.01); *B25B 21/023* (2013.01); *B25B 21/02* (2013.01)
USPC ..... 173/93.5; 173/93; 173/202

(58) Field of Classification Search
CPC ..... B25B 21/02; B25B 21/023
USPC ..... 173/93, 109, 93.6, 104, 112, 93.5, 202
See application file for complete search history.

(56) References Cited

U.S. PATENT DOCUMENTS

2002/0121384 A1 9/2002 Saito et al.
2009/0242222 A1 10/2009 Nagasaka et al.

FOREIGN PATENT DOCUMENTS

EP 1 574 294 A2 9/2005
JP A 2003-231067 8/2003

OTHER PUBLICATIONS

Extended European Search Report issued in European Application No. 11168914.7 filed on Feb. 14, 2013.

*Primary Examiner* — Michelle Lopez
(74) *Attorney, Agent, or Firm* — Oliff PLC

(57) ABSTRACT

To ensure that a hammer can retract by a sufficient amount without interfering with a washer receiving a rear end of a coil spring, there is disclosed an impact driver having a washer receiving a rear end of a coil spring biasing a hammer of an impact mechanism to an advanced position. The washer is annular with an inner diameter larger than an inner diameter of an annular groove disposed on a rear surface of the hammer, and includes a frontward extended portion disposed at an inner circumference of the washer. Between a carrier portion of the spindle and the washer, there is disposed a positioner that positions the washer coaxially with the spindle.

15 Claims, 4 Drawing Sheets

IMPACT TOOL

This application claims the benefit of the Japanese Patent Application No. 2010-153271 filed on Jul. 5, 2010, the entirety of which is incorporated by reference.

BACKGROUND OF THE INVENTION

1. Field of the Invention

The present invention relates to an impact tool such as an impact driver that has an anvil protruding frontward from a housing and makes the anvil generate a rotational impact force.

2. Description of Related Art

A conventional impact tool such as impact driver, as disclosed in Japanese Patent Application Publication No. 2003-231067, includes a spindle, an anvil, and an impact mechanism. The spindle is rotatable in a housing by means of a motor. The anvil is supported on the front side of the spindle to be rotatable coaxially with the spindle. A front end portion of the anvil, at which a tool bit is to be attached, protrudes frontward out of the housing. The impact mechanism transmits rotation of the spindle to the anvil as a rotational impact.

The impact mechanism includes a hammer, balls, and a coil spring. The hammer is fitted on the spindle such that the hammer is movable in the front-back direction, and has an annular groove disposed on a rear surface thereof. The balls are disposed in or between cam grooves disposed on the spindle and the hammer. The coil spring is inserted from its front end into the annular groove of the hammer to bias the hammer to an advanced position of the hammer to engage the hammer with the anvil. When the spindle is rotated, for instance for screwing, the hammer is rotated integrally with the spindle via the balls to rotate the anvil. When a load applied to the anvil increases, rearward movement of the hammer occurs against the biasing force of the coil spring because of the balls being rolled rearward along the cam grooves. Consequently, the hammer is disengaged from the anvil. After thus disengaged, the hammer being rotated is again engaged with the anvil by the biasing force of the coil spring with the balls being rolled frontward along the cam grooves. The engagement and disengagement of the hammer with and from the anvil is repeated so that a rotational impact is intermittently applied to the anvil.

A carrier portion of planetary gears is disposed on the rear side of the spindle of the impact tool, and a washer is disposed frontward of the carrier portion to receive a rear end of the coil spring biasing the hammer. The washer has an outer peripheral portion with which the rear end of the coil spring is held in contact, and a frontward extended portion circumferentially disposed at an inner circumference of the outer peripheral portion and fitted on the coil spring so as to inhibit radially inward contraction or deformation of the coil spring. Since the frontward extended portion of the washer is located on the rear side of the hammer, it is required in designing the impact tool to locate the range of the stroke of the hammer frontward of the washer such that when backward moved or retracted the hammer does not contact the frontward extended portion of the washer. This makes the axial dimension of the impact tool relatively large.

SUMMARY OF THE INVENTION

An object of this invention is to provide an impact tool that is downsized with a reduced axial dimension and can ensure a sufficiently long stroke of a hammer without interference of the hammer with a washer receiving a rear end of a coil spring.

To attain the above object, the invention provides an impact tool including a motor, a spindle, an anvil, an impact mechanism, a carrier portion, a washer, and a positioner. The motor is disposed in a housing and rotates the spindle. The anvil is supported by the housing and disposed on a front side of the spindle such that the anvil is rotatable coaxially with the spindle. The anvil has a front end portion at which a tool bit is to be attached and protruded frontward of the housing. The impact mechanism includes a hammer fitted on the spindle and movable in a front-back direction, balls fitted in and between cam grooves on the spindle and cam grooves on the hammer, and a coil spring whose front end portion is inserted into an annular groove on a rear surface of the hammer and biases the hammer to an advanced position of the hammer. The impact mechanism transmits rotation of the spindle to the anvil as a rotational impact force. The carrier portion is disposed in the spindle and on a rear side of the coil spring, and holds planetary gears for reducing the motor speed. The washer is disposed on the front side of the carrier portion and has an annular shape with a frontward extended portion disposed at an inner circumference of the annular shape. An inner diameter of the washer is larger than that of the annular groove, and the washer receives a rear end of the coil spring. The positioner is disposed between the carrier portion and the washer, for positioning the washer coaxially with the spindle.

The positioner may include a plurality of chamfers disposed in the carrier portion substantially along an axis of the spindle, recess portions respectively disposed in the chamfers, and engaging members disposed in the washer and engaged with the recess portions.

It is preferable that the chamfers are made to be a pair of chamfers parallel to each other, and the engaging members are a pair of engaging members disposed symmetrical with respect to a point.

It is preferable that the engaging members are formed by rearward bending parts of an outer peripheral portion of the washer, and are elastically deformable in a radial direction of the washer.

According to the impact tool, a sufficiently long stroke of the hammer can be ensured without interference of the hammer with the washer receiving the rear end of the coil spring. Since the axial dimension of the impact tool can be reduced, the impact tool can be downsized. Further, even through the positioner is included in the impact tool, the dimensions of the impact tool in the radial or other directions are not increased since the space inside the coil spring is made use of in ensuring the sufficiently long stroke of the hammer, thereby contributing to making the impact tool downsized.

The impact tool, in which the positioner includes a plurality of chamfers disposed in the carrier portion substantially along an axis of the spindle, recess portions respectively disposed in the chamfers, and engaging members disposed in the washer and engaged with the recess portions, has an advantage that the annular washer can be reliably positioned without a positional error, in addition to the above described advantages.

DETAILED DESCRIPTION OF THE PREFERRED EMBODIMENTS

Figure 1:
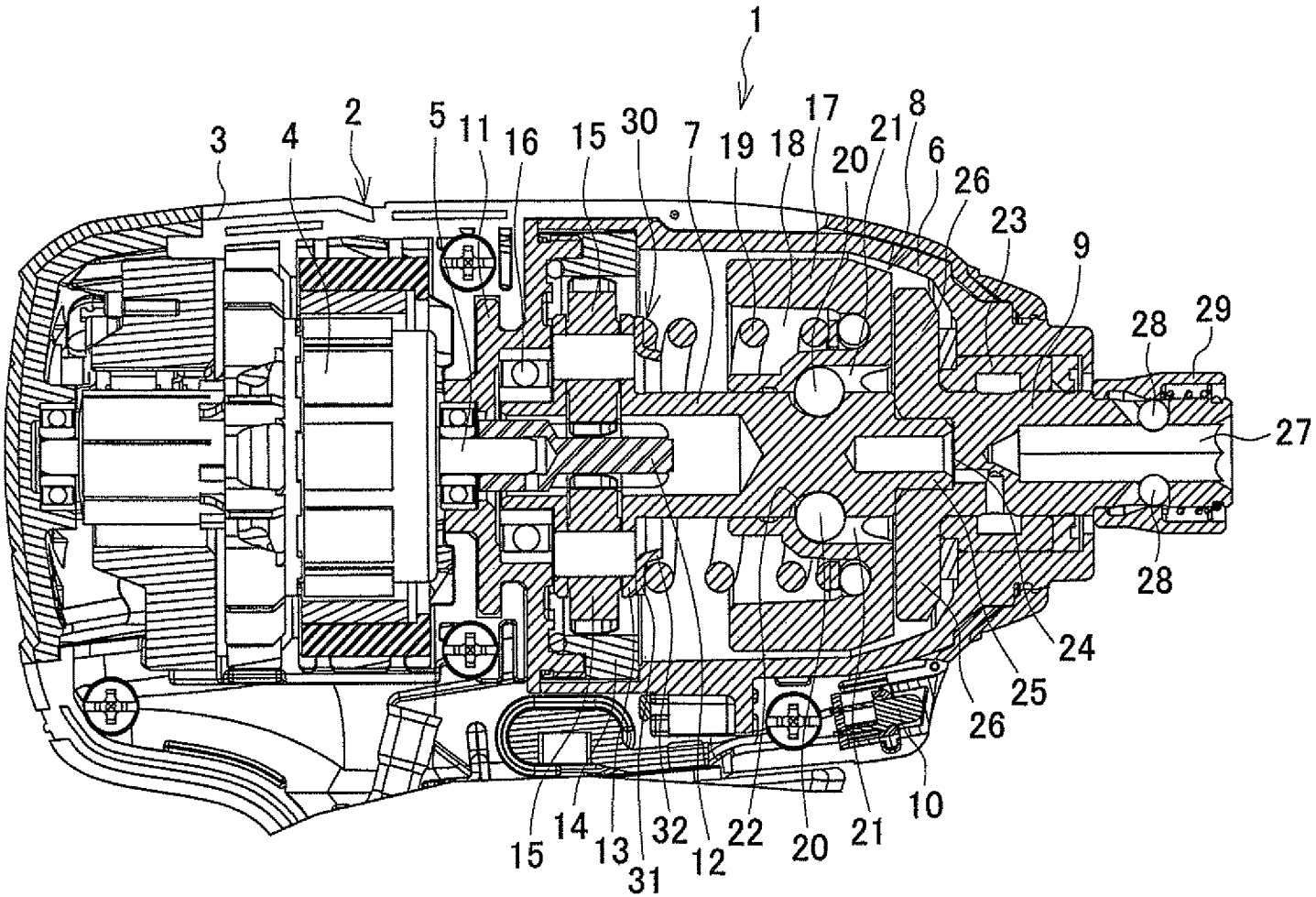
FIG. 1 is a vertical cross-sectional view of a part of an impact driver according to one embodiment of the invention.

Hereinafter, there will be described an impact driver as one example of an impact tool according to one embodiment of the invention, by referring to the drawings.

FIG. 1 is a fragmentary vertical cross-sectional view of the impact driver denoted by reference numeral 1. The impact driver 1 has a mainbody housing 2 and a hammer easing 6 bell-shaped in cross section. The mainbody housing 2 is disposed by assembling left and right housing halves 3, 3 and accommodates a motor 4. The hammer casing 6 is attached on a front side of the mainbody housing 2 (the right side as seen in FIG. 1), and accommodates a spindle 7, an impact mechanism 8, and an anvil 9. In the mainbody housing 2 and on an under surface of the hammer casing 6, a light unit 10 for illuminating the front side of the anvil 9 is attached in an inclined position such that a side of the light unit 10 from which light is emitted is oriented obliquely upward.

Figure 2A:
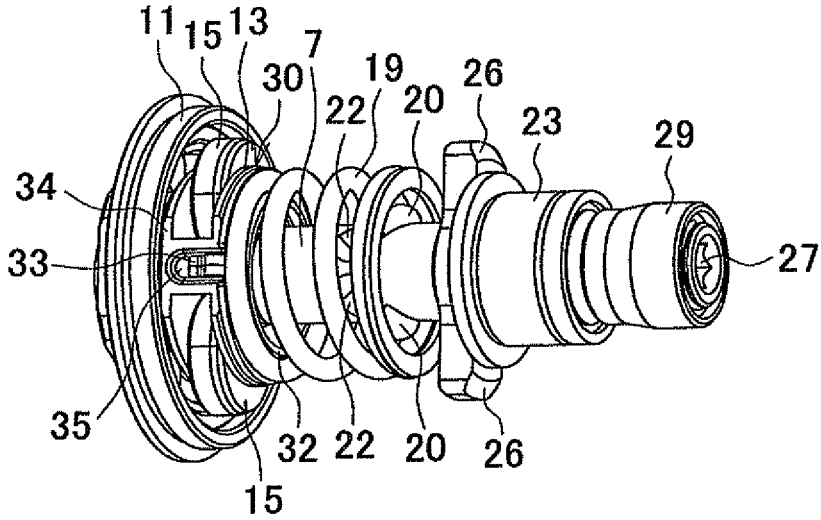
FIGS. 2A and 2B are perspective views of a spindle and an anvil of the impact driver as seen from a left side when the right side of FIGS. 2A and 2B is defined as a front side. The spindle and the anvil as shown in FIG. 2B are at an angular position as slightly rotated counterclockwise from the position of FIG. 2A as seen from the front side.
Figure 2B:
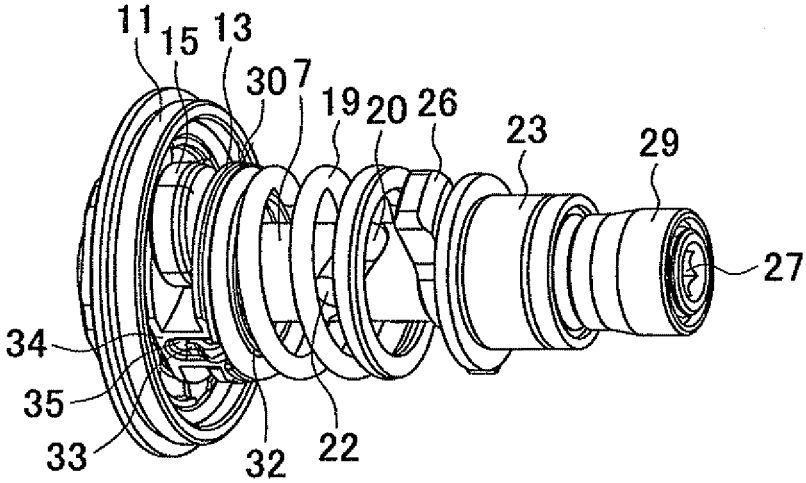
Figure 3A:
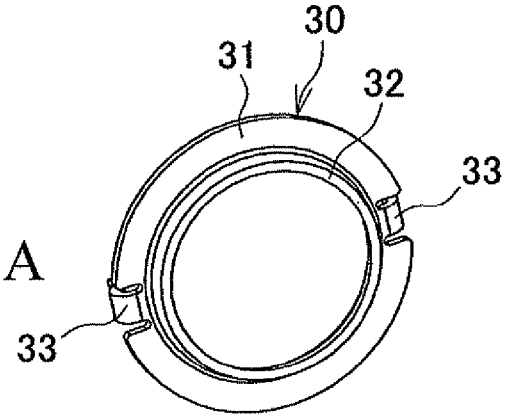
FIGS. 3A, 3B, 3C, and 3D illustrate a washer of the impact driver, and are respectively a perspective view, a front elevational view, a right side view, and a cross-sectional view taken along a line A-A in FIG. 3B.
Figure 3B:
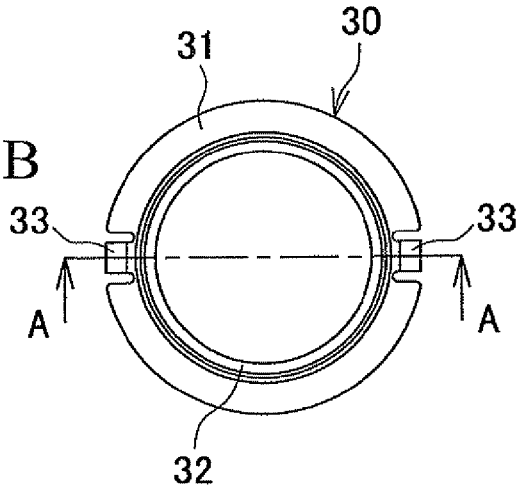
Figure 3C:
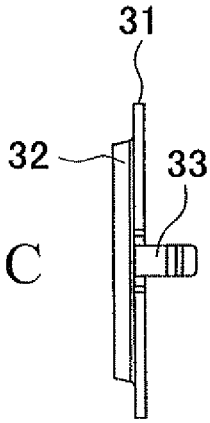
Figure 3D:
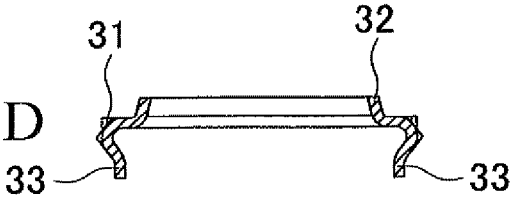
Figure 4A:
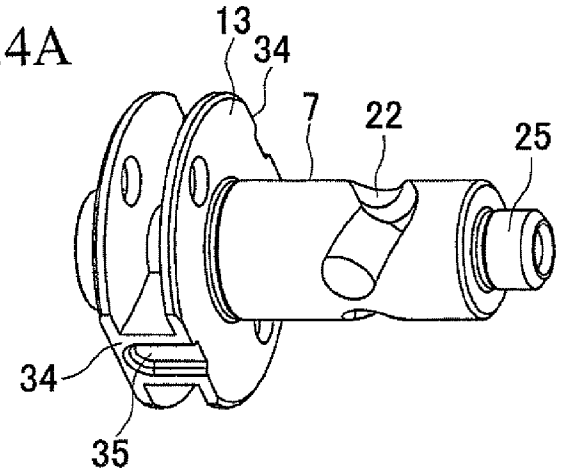
FIGS. 4A, 4B, 4C, and 4D illustrate the spindle, and are respectively a perspective view, a vertical cross-sectional view, a front elevational view, and a right side view of a rear portion.
Figure 4B:
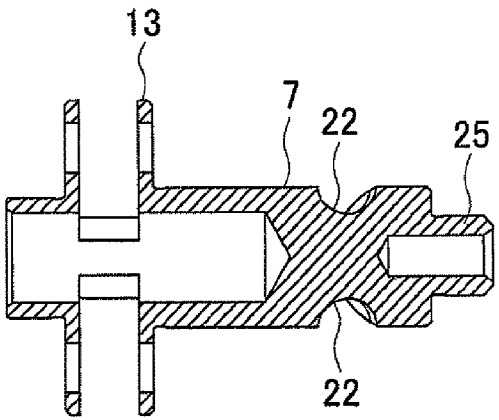
Figure 4C:
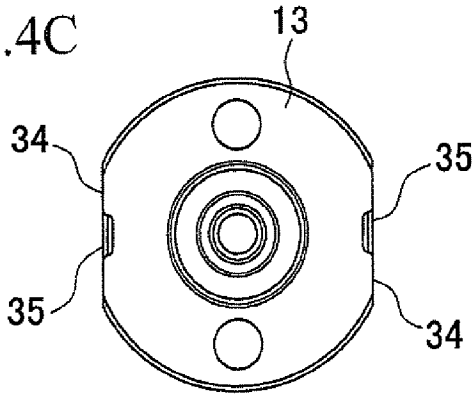
Figure 4D:
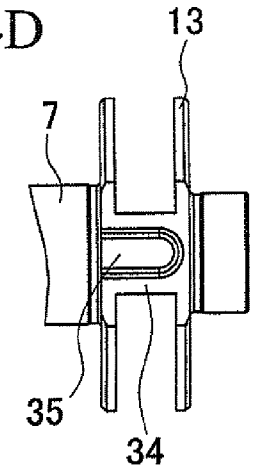

The motor 4 has an output shaft 5 on which a pinion 12 is fitted. The pinion 12 is rotatably supported by a gearcase 11 attached to the mainbody housing 2, and protrudes into the hammer casing 6. The spindle 7 has at its rear side a carrier portion 13 with a large diameter in the hammer casing 6, as shown in FIG. 2. The carrier portion 13 holds two planetary gears 15, 15 such that the planetary gears 15, 15 are rotatable inside an internal gear 14 around an axis in mesh with the pinion 12. A rear end portion of the spindle 7 is supported coaxially with the output shaft 5 by a ball bearing 16 supported by the gearcase 11.

The impact mechanism 8 includes a hammer 17 and a coil spring 19. The hammer 17 is fitted on a front end portion of the spindle 7. The coil spring 19 is attached to the hammer 17 such that a front end portion of the coil spring 19 is inserted in an annular groove 18 disposed on a rear surface of the hammer 17. The hammer 17 is coupled to the spindle 7 via balls 20, 20 disposed between the hammer 17 and the spindle 7. More specifically, the hammer 17 and the spindle 7 are coupled by the balls 20, 20 fitted in or between cam grooves 21, 21 on the hammer 17 and cam grooves 22, 22 on the spindle 7. The cam grooves 21, 21 of the hammer 17 are disposed on an inner circumferential surface of the hammer 17 to each extend rearward from a front end of the hammer 17 in a triangular shape, i.e., a shape narrowed at its rear end portion. The cam grooves 22, 22 of the spindle 7 are disposed on an outer circumferential surface of the spindle 7 in a V shape oriented such that its tip is on the front side. The hammer 17 is biased by the coil spring 19 to its advanced position in which the balls 20 are located at positions corresponding to the rear ends of the triangular cam grooves 21 of the hammer 17 and front ends or the tips of the V-shaped cam grooves 22 of the spindle 7.

The anvil 9 is rotatably supported at its middle portion by a bush 23 held at a front end of the hammer casing 6, and has a rear surface on which a bearing hole 24 is formed at a center or a position corresponding to an axis of the anvil 9. In the bearing hole 24, a small-diameter portion 25 disposed at a front end of the spindle 7 is fitted. At the rear end of the anvil 9, a pair of radially extending flanges 26, 26 with which claws (not shown) protruding from a front surface of the hammer 17 engage in the rotation direction, are provided in the hammer casing 6.

In a front end portion of the anvil 9 protruding out of the hammer casing 6, an insertion hole 27 for a tool bit (not shown), a chuck mechanism are disposed. The chuck mechanism includes balls 28 and a sleeve 29 to hold the tool bit as inserted in the insertion hole 27 and inhibit disengagement of the tool bit therefrom.

A washer 30 is disposed on a front surface of the carrier portion 13 of the spindle 7 to receive a rear end of the coil spring 19. As shown in FIG. 3, the washer 30 is an annular member including an outer peripheral portion 31 and a frontward extended portion 32. The frontward extended portion 32 is circumferentially disposed at an inner circumference of the outer peripheral portion 31 with which the coil spring 19 is held in contact. The frontward extended portion 32 has an inner diameter is larger than that of the annular groove 18 of the hammer 17. On the outer peripheral portion 31 of the washer 30, a pair of engaging members 33, 33 are disposed at respective positions that are symmetrical with respect to a point. Each of the engaging members 33 includes a part of the outer peripheral portion 31 bent rearward, and is elastically deformable in the radial direction of the washer 30.

On the other hand, as shown in FIGS. 4A-4D, the carrier portion 13 of the spindle 7 has a pair of generally flat faces 34, 34 disposed substantially along the axis of the spindle 7 and parallel to each other at positions corresponding to the engaging members 33, 33 of the washer 31. In each of the generally flat faces 34, a recess portion 35 is formed. In a state where the washer 30 is set on the front surface of the carrier portion 13, the engaging members 33 are inserted into and engaged with the respectively corresponding recess portions 35 from the front side. By the engaging members 33 thus being engaged with the recess portions 35, the washer 30 is held on the front surface of the carrier portion 13 coaxially with the spindle 7 such that the washer 30 is inhibited from rotating. The engaging members 33, the generally flat faces 34, and the recess portions 35 constitute a positioner of the washer 30.

When a switch trigger (not shown) disposed in the mainbody housing 2 is operated, the motor 4 starts rotating the output shaft 5. Then the rotation of the output shaft 5 is transmitted to the spindle 7 via the planetary gears 15, 15 to rotate the spindle 7 which further rotates the hammer 17 via the balls 20, 20. The rotation of the hammer 17 rotates the anvil 9 with which the hammer 17 is in engagement. Thus, screwing or the like is performed by the tool bit attached at the front end portion of the anvil 9. While the screwing is performed, a load applied to the anvil 9 increases to cause the rotation of the hammer 17 in engagement with the anvil 9 to be out of synchronization with the rotation of the spindle 7. Hence, with the balls 20, 20 being rolled along the cam grooves 22, 22, the hammer 17 retracts against the biasing force of the coil spring 19 while rotating relative to the spindle 7.

When the claws of the hammer 17 are disengaged from the flanges 26, 26 of the anvil 9, the hammer 17 is advanced by the biasing force of the coil spring 19 with the balls 20, 20 being rolled toward the front ends of the cam grooves 22, 22. Thus, the claws are again engaged with the flanges 26, 26 to produce an impact or a rotational impact force. The engagement and disengagement of the hammer 17 with and from the anvil 9 is repeated to perform further screwing.

Since an inner circumference of the annular groove 18 on the hammer 17 is located between the frontward extended portion 32 of the washer 30 and the spindle 7, the hammer 17 does not interfere with the washer when the hammer retracts. Hence, in designing the impact driver, it is not necessary to dispose the hammer at a front side so as to prevent interference of the hammer with the washer 30.

According to the impact driver 1, the washer 30 is disposed as an annular member that has, at its inner circumference, the frontward extended portion 32 whose inner diameter is larger than the inner diameter of the annular groove 18, and the positioner is disposed between the carrier portion 13 of the spindle 7 and the washer 30 so as to position the washer 30 coaxially with the spindle 7. Therefore, it is ensured that the hammer 17 can retract by a sufficient amount, or the stroke of the hammer 17 can be sufficiently long, without interference of the hammer with the washer 30 which receives the rear end of the coil spring 19 when the hammer retracts. Thus, the axial dimension of the impact driver can be made relatively small, thereby contributing to making the impact driver downsized.

Further, since the space inside the coil spring 19 is made use of in ensuring the sufficiently long stroke of the hammer 17, the dimensions of the impact driver in its radial or other directions are not increased even though the positioner is disposed in the impact driver, thereby contributing to making the impact tool downsized.

According to the arrangement where the positioner includes the two generally flat faces 34, 34 disposed on the carrier portion 13 substantially along the axis of the spindle 7, the recess portions 35, 35 disposed in the generally flat faces 34, 34, and the two engaging members 33, 33 disposed in the washer 30 and engaged with the recess portions 35, 35, the annular shaped washer 30 disposed in an annular shape can be reliably positioned without a positional error. Even in the event that one or both of the engaging members 33, 33 is/are disengaged from the recess portion(s) 35, the disengaged engaging part 33 is held in pressing contact with a corresponding one of the generally flat faces 34, with the relative position of the washer 30 to the spindle 7 kept the same, that is, with the washer 30 kept coaxial with the spindle 7, thereby enhancing the reliability.

It should be noted that the frontward extended portion is not limited to the one circumferentially disposed at the inner circumference of the washer, but may be one that is disposed at the inner circumference of the washer intermittently in the circumferential direction, that is, the frontward extended portion may be disposed in the form of a plurality of segments arranged circumferentially with a spacing interval from one another.

The positioner is not limited to the one described above, but may be otherwise disposed. For instance, the numbers of the generally flat faces and the engaging members may be three or larger, and only the recess portions may be disposed without forming the generally flat faces. Further, in place of the generally flat faces and the recess portions, a plurality of pairs of protrusions or ribs may be disposed with a spacing interval from one another on the carrier portion and substantially along the axis of the spindle 7, with each of the engaging members being engaged with one of the pairs of protrusions or ribs such that the engaging part is held between the pair of protrusions or ribs.

Further, the housing and the impact mechanism may be otherwise embodied with various modifications. For instance, the housing may not be disposed by attaching the hammer casing to the mainbody housing, but the mainbody housing and the hammer casing may be disposed as an integral member. It is to be understood that the invention is not limitedly applied to impact driver, but is equally applicable to other kinds of impact tools, e.g., angle impact driver and impact wrench.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An impact tool comprising:

a motor disposed in a housing;

a spindle rotatable by the motor;

an anvil supported by the housing and disposed on a front side of the spindle such that the anvil is rotatable coaxially with the spindle, the anvil having a front end portion, the front end portion being configured to receive a tool bit and frontward protruding out of the housing;

an impact mechanism including a hammer fitted on the spindle and movable in a front-back direction, balls fitted in and between cam grooves disposed on the spindle and cam grooves disposed on the hammer, and a coil spring whose front end portion is inserted into an annular groove disposed on a rear surface of the hammer and biases the hammer to an advanced position of the hammer, the impact mechanism transmitting rotation of the spindle to the anvil as a rotational impact force;

a carrier portion disposed in the spindle and on a rear side of the coil spring, and holding planetary gears for reducing the motor speed;

a washer disposed on the front side of the carrier portion and having an annular shape with a frontward extended portion disposed at an inner circumference of the annular shape, an inner diameter of the frontward extended portion being larger than that of the annular groove, and receiving a rear end of the coil spring; and a positioner disposed between the carrier portion and the washer, and positioning the washer coaxially with the spindle.

2. The impact tool according to claim 1, wherein the positioner includes a plurality of chamfers disposed in the carrier portion substantially along an axis of the spindle, recess portions respectively disposed in the chamfers, and engaging members disposed in the washer and engaged with the recess portions.

3. The impact tool according to claim 2, wherein the chamfers are a pair of chamfers disposed parallel to each other, and the engaging members are a pair of engaging members disposed symmetrically with respect to a point.

4. The impact tool according to claim 3, wherein the engaging members include rearward bent parts of an outer peripheral portion of the washer, and are elastically deformable in a radial direction of the washer.

5. The impact tool according to claim 2, wherein the engaging members include rearward bent parts of an outer peripheral portion of the washer, and are elastically deformable in a radial direction of the washer.

6. The impact tool according to claim 1, wherein the cam grooves of the spindle are disposed on an outer circumferential surface of the spindle and each have a V shape oriented such that a tip of the V shape is located on the front side, and the cam grooves of the hammer are disposed on an inner circumferential surface of the hammer and extend rearward from a front end of the hammer in a shape narrowed at its rear end portion.

7. The impact tool according to claim 1, wherein the cam grooves of the spindle are a pair of cam grooves and the cam grooves of the hammer are a pair of cam grooves, and the balls are a pair of balls.

8. The impact tool according to claim 1, wherein a bearing hole is disposed on a rear surface of the anvil and at a position corresponding to an axis of the anvil, and the spindle has a small-diameter portion at a front end of the spindle, and wherein the anvil coaxially supports the front end of the spindle by the small-diameter portion of the spindle being fitted in the bearing hole of the anvil.

9. The impact tool according to claim 1, wherein the anvil has at its rear end a pair of radially extending flanges, and a rotational impact force of the hammer is transmitted to the anvil by engaging and disengaging the hammer with and from the flanges in accordance with an increase in a load applied to the anvil.

10. The impact tool according to claim 1, further comprising a retaining member formed integral with the washer, the retaining member being elastically deformable and configured to hold the washer on the spindle.

11. The impact tool according to claim 1, further comprising a retaining member configured to hold the washer on the spindle, the retaining member being disposed radially outside of the planetary gears.

12. The impact tool according to claim 1, wherein the washer includes an engaging member configured to engage with the spindle.

13. An impact tool comprising:

a motor;

a spindle rotatable by the motor;

a hammer disposed on an outer circumference side of the spindle;

balls disposed between the spindle and the hammer, a rotational force of the spindle being transferred to the hammer via the balls;

a coil spring, a forward side of the coil spring contacting and biasing the hammer to an advanced position;

a washer disposed on a rear side of the coil spring; and a retaining member formed integral with the washer, the retaining member being elastically deformable and configured to hold the washer on the spindle.

14. An impact tool comprising:

a motor;

a spindle rotatable by the motor;

a hammer disposed on an outer circumference side of the spindle;

planetary gears held by the spindle, the planetary gears transferring a rotational force of the motor to the spindle;

balls disposed between the spindle and the hammer, a rotational force of the spindle being transferred to the hammer via the balls;

a coil spring, a forward side of the coil spring contacting and biasing the hammer to an advanced position;

a washer disposed on a rear side of the coil spring; and a retaining member configured to hold the washer on the spindle, the retaining member being disposed radially outside of the planetary gears.

15. An impact tool comprising:

a motor;

a spindle rotatable by the motor;

a hammer disposed on an outer circumference side of the spindle;

balls disposed between the spindle and the hammer, a rotational force of the spindle being transferred to the hammer via the balls;

a coil spring, a forward side of the coil spring contacting and biasing the hammer to an advanced position; and a washer disposed on a rear side of the coil spring, the washer having i) a frontward extended portion disposed at an inner circumference of the rear side of the coil spring and ii) an engaging member configured to engage with the spindle.

* * * * *